US010247164B2

(12) United States Patent
Kinoshita et al.

(10) Patent No.: US 10,247,164 B2
(45) Date of Patent: Apr. 2, 2019

(54) IGNITION APPARATUS

(71) Applicant: DENSO CORPORATION, Kariya, Aichi-pref. (JP)

(72) Inventors: Shota Kinoshita, Nishio (JP); Fumiaki Aoki, Nishio (JP); Akimitsu Sugiura, Kariya (JP); Kaori Doi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/694,013

(22) Filed: Sep. 1, 2017

(65) Prior Publication Data

US 2018/0066624 A1 Mar. 8, 2018

(30) Foreign Application Priority Data

Sep. 2, 2016 (JP) ..... 2016-172216

(51) Int. Cl.
*F02P 3/055* (2006.01)
*F02P 17/02* (2006.01)
(Continued)

(52) U.S. Cl.
CPC ..... *F02P 3/055* (2013.01); *F02P 3/005* (2013.01); *F02P 3/01* (2013.01); *F02P 9/002* (2013.01);
(Continued)

(58) Field of Classification Search
CPC ..... F02P 3/00; F02P 3/01; F02P 3/04; F02P 3/0435; F02P 3/05; F02P 3/055; F02P 9/002; F02P 9/007; F02P 15/10; F02P 17/02; F02P 23/04; H01F 38/12; H01T 15/00
(Continued)

(56) References Cited

U.S. PATENT DOCUMENTS 5,408,870 A * 4/1995 Noble ..... F02P 3/02 73/114.13
5,411,006 A * 5/1995 Noble ..... F02P 3/02 123/634
(Continued)

FOREIGN PATENT DOCUMENTS

JP 2008-88947 4/2008
JP 5676721 2/2015

*Primary Examiner* — Hung Q Nguyen
*Assistant Examiner* — Johnny H Hoang
(74) *Attorney, Agent, or Firm* — Nixon & Vanderhye P.C.

(57) ABSTRACT

An ignition apparatus includes an ignition plug, a boost transformer, an ignition power source and a measurement unit. The ignition plug has a center electrode and a ground electrode. The boost transformer supplies the ignition plug with electric power generated in a secondary coil upon supply of AC power from the ignition power source to a primary coil. The measurement unit measures the discharge voltage of the ignition plug. The ignition power source includes a discharge state determining unit that determines the discharge state of the ignition plug based on the measured discharge voltage and a current controlling unit that controls electric current supplied to the primary coil. When a discharge path formed between the center and ground electrodes of the ignition plug is determined by the discharge state determining unit as being in an over-extended state, the current controlling unit reduces the electric current supplied to the primary coil.

9 Claims, 9 Drawing Sheets

(51) Int. Cl.

| | |
|---|---|
| ***H01T 15/00*** | (2006.01) |
| ***H01F 38/12*** | (2006.01) |
| ***F02P 3/01*** | (2006.01) |
| ***F02P 3/00*** | (2006.01) |
| ***F02P 9/00*** | (2006.01) |
| *F02P 5/15* | (2006.01) |
| *F02P 17/12* | (2006.01) |

(52) U.S. Cl.
CPC ..... *F02P 17/02* (2013.01); *H01F 38/12* (2013.01); *H01T 15/00* (2013.01); *F02P 5/1502* (2013.01); *F02P 2017/121* (2013.01)

(58) Field of Classification Search
USPC ... 123/143 R, 606, 607, 616, 617, 620, 623, 123/628, 629
See application file for complete search history.

(56) References Cited

U.S. PATENT DOCUMENTS 6,046,551 A * 4/2000 Kita ..... H05B 41/2883 315/291
6,112,730 A * 9/2000 Marrs ..... F02P 23/04 123/606
6,123,063 A * 9/2000 Boerjes ..... F02P 3/0435 123/598
6,135,099 A * 10/2000 Marrs ..... F02P 3/0884 123/606
6,216,530 B1 * 4/2001 Shimizu ..... F02P 17/12 73/114.08
6,222,367 B1 * 4/2001 Shimizu ..... F02P 17/12 324/378
9,784,232 B1 * 10/2017 Marrs ..... F02P 9/002
9,903,335 B2 * 2/2018 Kinoshita ..... F02P 9/002
2004/0070995 A1 * 4/2004 Sugimoto ..... H02M 3/33507 363/20
2005/0000502 A1 * 1/2005 Waters ..... F02P 3/0453 123/620
2007/0103092 A1 * 5/2007 Millner ..... H01J 37/321 315/276
2009/0161287 A1 * 6/2009 Kandah ..... H03K 5/08 361/263
2010/0073844 A1 * 3/2010 Osa ..... F23Q 3/004 361/263
2013/0076362 A1 * 3/2013 Steinrueck ..... F02P 17/12 324/382
2013/0291833 A1 * 11/2013 Eisen ..... F02P 3/053 123/406.12
2014/0020666 A1 * 1/2014 Plotnikov ..... F02P 23/04 123/606
2015/0115827 A1 4/2015 Itoi et al.
2016/0298590 A1 * 10/2016 Garrard ..... F02P 3/08
2017/0279249 A1 * 9/2017 Yamada ..... H01T 15/00

* cited by examiner

IGNITION APPARATUS

CROSS-REFERENCE TO RELATED APPLICATION

This application is based on and claims priority from Japanese Patent Application No. 2016-172216 filed on Sep. 2, 2016, the content of which is hereby incorporated by reference in its entirety into this application.

BACKGROUND

1 Technical Field

The present invention relates to ignition apparatuses for use in engines.

2 Description of Related Art

Japanese Patent No. JP5676721B1 discloses an ignition apparatus for use in an engine. The ignition apparatus includes a spark discharge producing device, a resonance device, a current supply device, a current level detection device and a control device. The spark discharge producing device generates a predetermined high voltage and supplies the generated predetermined high voltage to an ignition plug, thereby forming a spark discharge path in a gap of the ignition plug. The resonance device is composed of an inductor and a capacitor. The current supply device supplies, via the resonance device, AC current to the spark discharge path formed in the gap of the ignition plug. The current level detection device detects the level of the AC current supplied from the current supply device to the spark discharge path or a level corresponding to the level of the AC current, and outputs a value representing the detected level. The control device controls, based on the value outputted from the current level detection device, the output of the AC current supplied by the current supply device.

In recent years, lean-burn engines, in which fuel is burned in a state leaner than the stoichiometric state, have been put into practical use. With lean-burn engines, it is possible to improve fuel economy and reduce NOx emission; therefore, lean-burn engines have become widely employed. Moreover, in lean-burn engines, measures are taken to improve the ignitability in the lean state; these measures include enhancing the ignition energy and setting the discharge time in the ignition plug to be long.

With a longer discharge time, the discharged spark may be blown by the flow of air-fuel mixture in the combustion chamber. With the discharged spark blown, the air-fuel mixture in the vicinity of the discharged spark may be activated, thereby making it possible to realize good combustion even in the lean state.

However, the blowing of the discharged spark is not constant; therefore, there is variation in the length of the discharge path. The combustion state of the air-fuel mixture when it is ignited with the discharge path formed to be relatively long is different from that when it is ignited with the discharge path formed to be relatively short. This may cause the output torque of the engine to vary between each combustion cycle.

SUMMARY

According to an exemplary embodiment, there is provided an ignition apparatus which includes an ignition plug, a boost transformer, an ignition power source and a measurement unit. The ignition plug has a center electrode and a ground electrode to produce a discharge therebetween upon being supplied with electric power. The boost transformer has a primary coil and a secondary coil magnetically coupled with each other. The boost transformer is configured to supply the ignition plug with the electric power that is generated in the secondary coil by electromagnetic induction upon supply of AC power to the primary coil. The ignition power source is configured to supply the primary coil of the boost transformer with the AC power. The measurement unit is configured to measure at least one of discharge voltage and discharge current of the ignition plug. The ignition power source includes a controller that has a discharge state determining unit configured to determine the discharge state of the ignition plug based on the at least one of the discharge voltage and the discharge current measured by the measurement unit and a current controlling unit configured to control electric current supplied to the primary coil of the boost transformer. The controller is configured so that when a discharge path formed between the center and ground electrodes of the ignition plug is determined by the discharge state determining unit as being in an over-extended state, the current controlling unit reduces the electric current supplied to the primary coil of the boost transformer.

With the above configuration, when the discharge path formed between the center and ground electrodes of the ignition plug is excessively extended by the flow of an air-fuel mixture in a combustion chamber, the electric current supplied to the primary coil of the boost transformer is reduced by the current controlling unit, thereby reducing drive current of the ignition plug. Moreover, with the reduction in the drive current of the ignition plug, the impedance of the discharge is increased. Forming a short circuit of the discharge and thereby shortening the discharge path is advantageous to lowering the impedance of the discharge; thus formation of a short circuit is promoted. Consequently, a short circuit of the discharge is formed within the air-fuel mixture, thereby shortening the discharge path. As a result, it becomes possible to prevent the discharge path from becoming excessively long, thereby suppressing variation in the discharge shape between each combustion cycle.

BRIEF DESCRIPTION OF THE DRAWINGS

The present invention will be understood more fully from the detailed description given hereinafter and from the accompanying drawings of one exemplary embodiment, which, however, should not be taken to limit the present invention to the specific embodiment but are for the purpose of explanation and understanding only.

In the accompanying drawings.

DESCRIPTION OF EMBODIMENT

Figure 1:
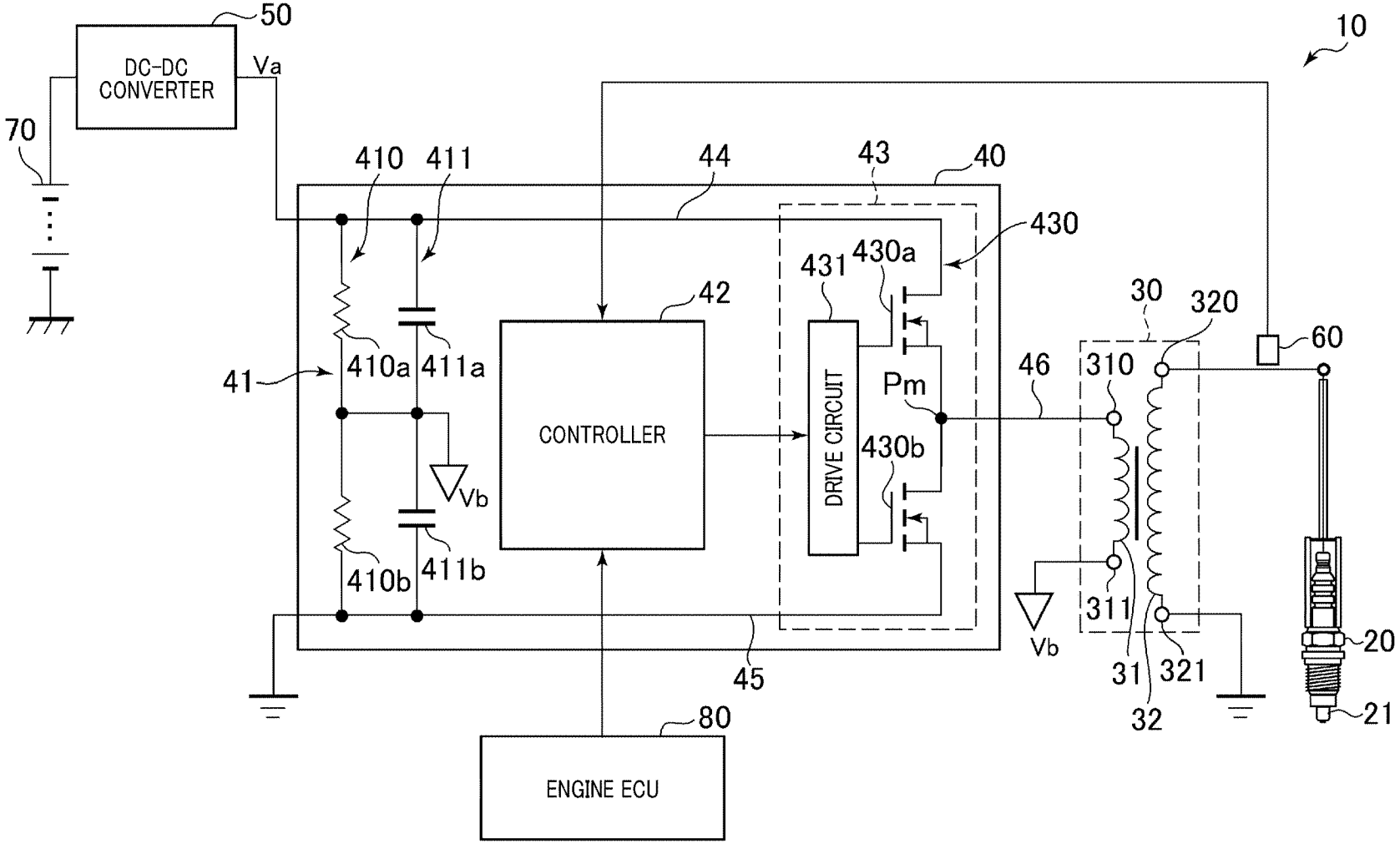
FIG. 1 is a block diagram illustrating the overall configuration of an ignition apparatus according to an embodiment.

FIG. 1 shows the overall configuration of an ignition apparatus 10 according to an embodiment.

In the present embodiment, the ignition apparatus 10 is mounted to a cylinder of an engine of a vehicle to produce a spark discharge and thereby ignite an air-fuel mixture in a combustion chamber formed in the cylinder.

As shown in FIG. 1, the ignition apparatus 10 includes an ignition plug 20, a boost transformer 30, an ignition power source 40, a DC-DC converter 50 and a measurement device 60.

The ignition plug 20 is mounted to a cylinder head of the engine so that a distal end portion 21 of the ignition plug 20 is located in the combustion chamber. In the present embodiment, the ignition plug 20 is implemented by a surface discharge plug (or creeping discharge plug).

Figure 2:
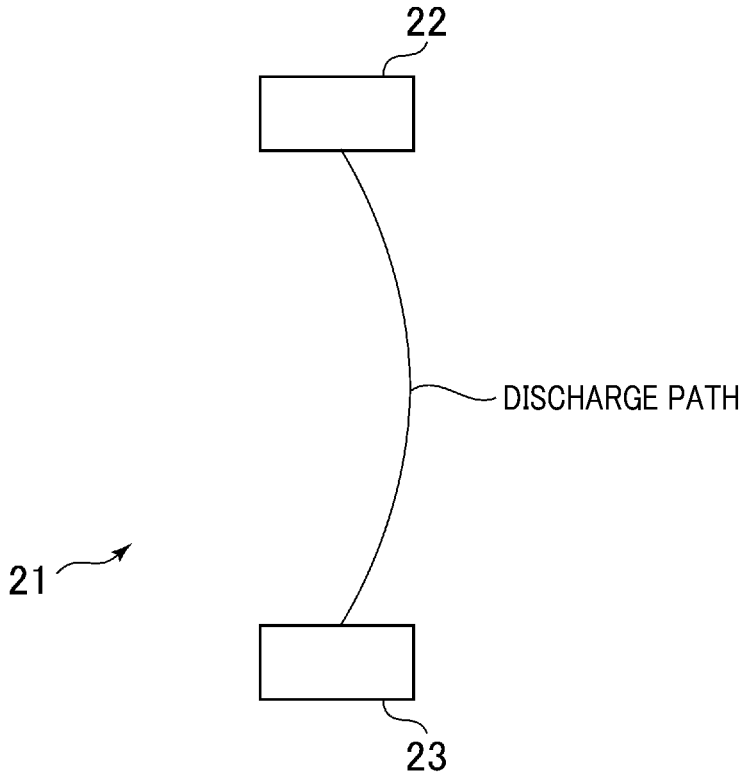
FIG. 2 is a schematic view illustrating a discharge path formed between a center electrode and a ground electrode of an ignition plug of the ignition apparatus.

Referring to FIG. 2, the ignition plug 20 has a center electrode 22 and a ground electrode 23, both of which are included in the distal end portion 21 of the ignition plug 20. Upon being supplied with electric power from the boost transformer 30, the ignition plug 20 produces a discharge between the center electrode 22 and the ground electrode 23, thereby igniting the air-fuel mixture in the combustion chamber. More specifically, in the present embodiment, upon application of a high-frequency voltage to the ignition plug 20 by the boost transformer 30, the ignition plug 20 first produces and propagates a streamer discharge along its surface and then causes an AC glow/arc discharge between the center electrode 2 and the ground electrode 3.

Referring back to FIG. 1, the measurement device 60 measures (or detects) the discharge voltage (i.e., the high-frequency voltage) applied to the ignition plug 20 and outputs a signal indicative of the measured discharge voltage.

The boost transformer 30 generates, based on AC power supplied from the ignition power source 40, electric power necessary for the ignition plug 20 to produce a discharge. The boost transformer 30 has a primary coil 31 and a secondary coil 32 that are magnetically coupled with each other.

The primary coil 31 has a first end 310 electrically connected with an output wire 46 of the ignition power source 40 and a second end 311 to which a reference voltage Vb generated by the ignition power source 40 is applied.

To the primary coil 31, there is supplied the AC power from the ignition power source 40. Hereinafter, for the sake of convenience of explanation, when the electric potential at the first end 310 of the primary coil 31 is higher than the electric potential at the second end 311 of the primary coil 31, the voltage applied between the first and second ends 310 and 311 is referred to as a "positive voltage"; in contrast, when the electric potential at the second end 311 is higher than the electric potential at the first end 310, the voltage applied between the first and second ends 310 and 311 is referred to as a "negative voltage".

The secondary coil 32 has a first end 320 electrically connected with the ignition plug 20 and a second end 321 grounded.

In the boost transformer 30, when the AC power is supplied from the ignition power source 40 to the primary coil 31, an electromotive force is induced in the secondary coil 32 by electromagnetic induction, causing induced current to flow in the secondary coil 32. Moreover, with the induced current flowing in the secondary coil 32, the discharge voltage is applied to the ignition plug 20, thereby supplying drive current to the ignition plug 20 to produce a discharge between the center and ground electrodes 22 and 23 of the ignition plug 20.

More specifically, the drive voltage applied to the ignition plug 20 by the boost transformer 30 depends on the ratio between the number of turns of the primary coil 31 and the number of turns of the secondary coil 32 and the voltage gain due to resonance between the stray capacitance downstream of the secondary coil 32 and the leakage inductance of the boost transformer 30. In the case of causing the ignition plug 20 to produce the glow/arc discharge with the streamer discharge being a leader stroke in a high-pressure condition in the engine, it is necessary to apply to the ignition plug 20 a very high drive voltage of, for example, higher than or equal to 30 kVp-p. The boost transformer 30 is configured to boost its high-frequency output voltage to a required drive voltage of the ignition plug 20.

The DC-DC converter 50 boosts a DC voltage outputted from a battery 70 provided in the vehicle to a higher DC voltage Va and applies the obtained higher DC voltage Va to a high potential-side busbar (or wiring) 44 of the ignition power source 40. The DC voltage Va applied by the DC-DC converter 50 to the ignition power source 40 is set to be in the range of, for example, 100 to 600V.

The ignition power source 40 generates, based on the DC power supplied from the DC-DC converter 50 via the high potential-side busbar 44, the high-frequency AC power to be supplied to the primary coil 31 of the boost transformer 30. In addition, the high-frequency AC power outputted from the ignition power source 40 may be in the form of a continuous wave (e.g., a continuous rectangular wave) or a pulse train.

In the present embodiment, the ignition power source 40 includes a voltage divider 41, a controller 42 and a switching unit 43.

The voltage divider 41 includes a serially-connected resistor pair 410 that consists of a pair of resistors 410*a* and 410*b* electrically connected in series with each other and a serially-connected capacitor pair 411 that consists of a pair of capacitors 411*a* and 411*b* electrically connected in series with each other.

The serially-connected resistor pair 410 has a first end electrically connected with the high potential-side busbar 44 and a second end electrically connected with a low potential-side busbar (or wiring) 45 of the ignition power source 40. Similarly, the serially-connected capacitor pair 411 has a first end electrically connected with the high potential-side busbar 44 and a second end electrically connected with the low potential-side busbar 45. In addition, the low potential-side busbar 45 is grounded.

The voltage divider 41 produces a reference voltage Vb by dividing the DC voltage Va outputted from the DC-DC converter 50 with the pair of resistors 410*a* and 410*b*.

The switching unit 43 includes a half-bridge circuit 430, which is composed of two switching elements 430*a* and 430*b*, and a drive circuit 431.

Each of the switching elements 430*a* and 430*b* is implemented by, for example, a FET (Field-Effect Transistor). The half-bridge circuit 430 has a first end electrically connected with the high potential-side busbar 44 and a second end electrically connected with the low potential-side busbar 45. The mid-point (or junction point) Pm between the two switching elements 430*a* and 430*b* is electrically connected with the first end 310 of the primary coil 31 of the boost transformer 30 via the output wire 46.

The drive circuit 431 is provided to turn on and off the switching elements 430*a* and 430*b*. When the switching element 430*a* is in an ON state and the switching element 430*b* is in an OFF state, a positive voltage, which corresponds to the difference between the DC voltage Va applied by the DC-DC converter 50 and the reference voltage Vb, is applied between the first and second ends 310 and 311 of the primary coil 31 of the boost transformer 30. On the other hand, when the switching element 430*a* is in an OFF state and the switching element 430*b* is in an ON state, a negative voltage, which corresponds to the reference voltage Vb, is applied between the first and second ends 310 and 311 of the primary coil 31 of the boost transformer 30.

The drive circuit 431 converts the DC power supplied from the DC-DC converter 50 into the high-frequency AC power by turning on and off the switching elements 430*a* and 430*b* in accordance with a drive signal outputted from the controller 42.

The controller 42 is configured mainly with a microcomputer which includes a CPU (Central Processing Unit) and a memory. The controller 42 generates the drive signal on the basis of command signals outputted from an engine ECU (Electronic Control Unit) 80 and the output signal of the measurement device 60; then the controller 42 outputs the generated drive signal to the drive circuit 431.

Specifically, the command signals outputted from the engine ECU 80 to the controller 42 include an ignition signal IGw indicative of both ignition start timing (more precisely, discharge start timing) and an ignition period (more precisely, discharge period) of the ignition plug 20 and a reference current signal indicative of a reference current value Isb. Here, the reference current value Isb is a reference value of electric current to be supplied to the primary coil 31 of the boost transformer 30. The engine ECU 80 sets the reference current value Isb, the ignition start timing and the ignition period on the basis of various parameters that represent the state of the engine or the state of the vehicle and are detected by sensors (not shown) provided in the engine or in the vehicle. For example, in the case of burning fuel in the engine in a lean state that is leaner than the stoichiometric state, the engine ECU 80 sets the reference current value Isb so as to be suitable for burning fuel in the lean state. Moreover, when it is determined that the set ignition timing has arrived, the engine ECU 80 switches the ignition signal IGw from an OFF state to an ON state. Furthermore, the engine ECU 80 keeps the ignition signal IGw in the ON state until the set ignition period elapses from the time instant at which the ignition signal IGw is switched to the ON state.

Figure 3:
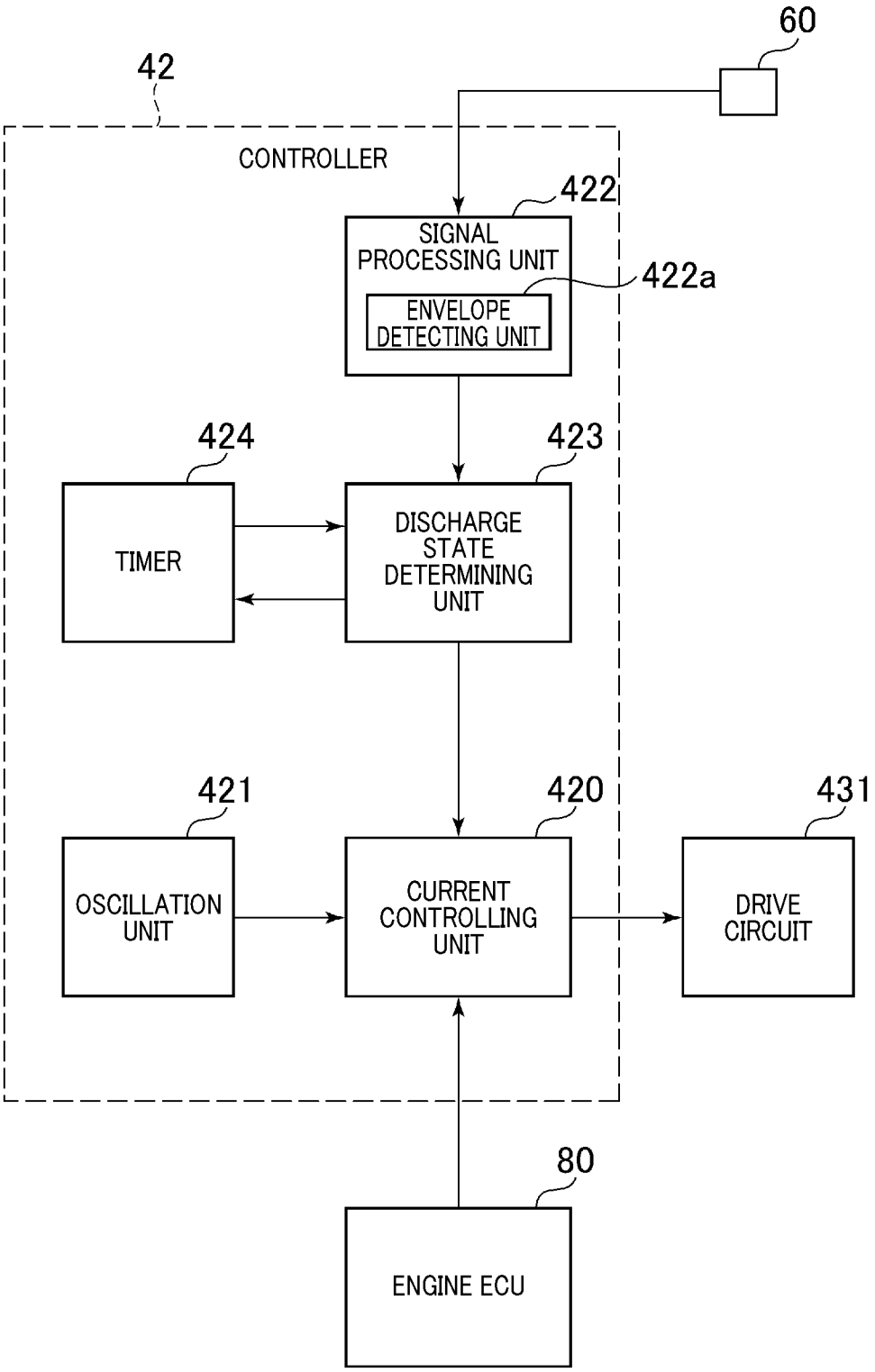
FIG. 3 is a block diagram illustrating the configuration of a controller of an ignition power source of the ignition apparatus.

FIG. 3 shows the configuration of the controller 42 according to the present embodiment.

As shown in FIG. 3, the controller 42 includes a current controlling unit 420, an oscillation unit 421, a signal processing unit 422, a discharge state determining unit 423 and a timer 424.

In the controller 42, the current controlling unit 420 and the oscillation unit 421 are provided to generate the drive signal.

Specifically, the current controlling unit 420 receives, from the engine ECU 80, both the ignition signal IGw and the reference current signal indicative of the reference current value Isb. When the ignition signal IGw is switched from the OFF state to the ON state, the current controlling unit 420 determines that the ignition start timing has arrived. Then, the current controlling unit 420 calculates a voltage duty ratio on the basis of the reference current value Isb. Here, the voltage duty ratio denotes the ratio of ON time to OFF time in each pulse cycle of the drive signal.

Based on the calculated voltage duty ratio and a carrier signal generated by and outputted from the oscillation unit 421, the current controlling unit 420 generates the drive signal and outputs the generated drive signal to the drive circuit 431. Consequently, the drive circuit 431 can turn on and off the switching elements 430*a* and 430*b* in accordance with the drive signal. Moreover, with the on/off operation of the switching elements 430*a* and 430*b*, the high-frequency AC power is generated from the DC power supplied from the DC-DC converter 50. Then, the generated high-frequency AC power is supplied to the primary coil 31 of the boost transformer 30.

In addition, the magnitude of the AC voltage applied to the primary coil 31 of the boost transformer 30 is set based on the voltage duty ratio. In the present embodiment, to cause resonance between the stray capacitance downstream of the secondary coil 32 and the leakage inductance of the boost transformer 30, the frequency of the AC voltage is set to, for example, (800 kHz±500 kHz) and thus higher than the frequency of a general switching power source (e.g., several tens of kHz). Therefore, it is possible to finely control the voltage duty ratio and the frequency of the AC voltage, thereby lowering the probability that the discharge of the ignition plug 20 be blown off by the flow of the air-fuel mixture in the combustion chamber.

Upon supply of the high-frequency AC power to the primary coil 31, the induced current flows in the secondary coil 32 of the boost transformer 30, causing the drive current to be supplied to the ignition plug 20. Consequently, a discharge is produced between the center and ground electrodes 22 and 23 of the ignition plug 20. The current controlling unit 420 of the controller 42 continues outputting the drive signal to the drive circuit 431 during the ignition period for which the ignition signal IGw is kept in the ON state. Thus, the supply of the drive current to the ignition plug 20 is continued for the ignition period.

Moreover, in the present embodiment, during the ignition period for which the ignition signal IGw is kept in the ON state, the controller 42 detects the discharge voltage of the ignition plug 20 on the basis of the output signal of the measurement device 60. Then, based on the detected discharge voltage of the ignition plug 20, the controller 42 determines the state of the discharge produced between the center and ground electrodes 22 and 23 of the ignition plug 20. Thereafter, based on the determined discharge state, the controller 42 adjusts (i.e., increases or reduces) the drive current supplied to the ignition plug 20, thereby suppressing variation in the discharge shape between each combustion cycle.

In the controller 42, the signal processing unit 422, the discharge state determining unit 423 and the timer 424 are provided to determine the discharge state of the ignition plug 20 and adjust the drive current of the ignition plug 20 based on the determined discharge state.

Specifically, the signal processing unit 422 extracts, from the output signal of the measurement device 60, information on the discharge voltage of the ignition plug 20. As shown in FIG. 3, the signal processing unit 422 includes an envelope detecting unit 422*a* that detects the envelope of the discharge voltage of the ignition plug 20. The signal processing unit 422 outputs the envelope of the discharge voltage detected by the envelope detecting unit 422*a* to the discharge state determining unit 423.

The discharge state determining unit 423 determines the state of the discharge produced between the center and ground electrodes 22 and 23 of the ignition plug 20 on the basis of the envelope of the discharge voltage outputted from the signal processing unit 422 and the time counted by the timer 424. Based on the discharge state of the ignition plug 20 determined by the discharge state determining unit 423, the current controlling unit 420 adjusts the voltage duty ratio, thereby adjusting the AC current supplied to the primary coil 31 of the boost transformer 30 and thus the drive current of the ignition plug 20. More specifically, in the case where it is necessary to increase the drive current of the ignition plug 20, the current controlling unit 420 increases the voltage duty ratio; in contrast, in the case where it is necessary to reduce the drive current of the ignition plug 20, the current controlling unit 420 reduces the voltage duty ratio.

Next, the process of the controller 42 for adjusting the drive current of the ignition plug 20 will be described in detail with reference to FIG. 4.

The controller 42 starts performing the process when the ignition signal IGw is switched from the OFF state to the ON state, i.e., at the ignition start timing.

First, at step S10, the discharge state determining unit 423 of the controller 42 determines whether a discharge is produced between the center and ground electrodes 22 and 23 of the ignition plug 20.

Figure 5:
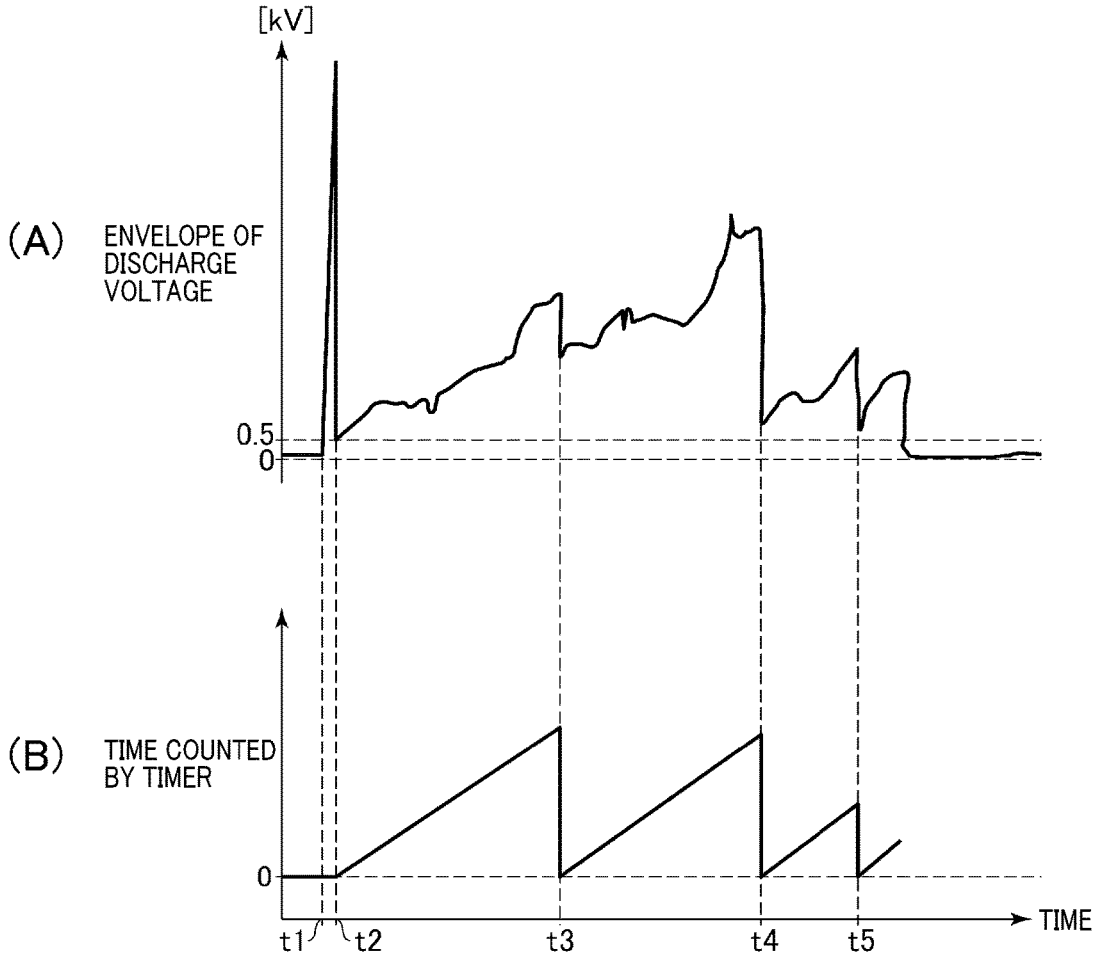
FIG. 5 is a time chart illustrating the relationship between the envelope of the discharge voltage of the ignition plug and the time counted by a timer, wherein (A) shows the change with time of the envelope of the discharge voltage and (B) shows the change with time of the time counted by the timer.

Specifically, as shown in FIG. 5(A), upon start of the supply of the drive current to the ignition plug 20 at, for example, a time instant t1, the absolute value Vd of the envelope of the discharge voltage of the ignition plug 20 detected by the signal processing unit 422 of the controller 42 increases. Then, upon a discharge being produced between the center and ground electrodes 22 and 23 of the ignition plug 20, the absolute value Vd of the envelope of the discharge voltage decreases. In view of the above, in the present embodiment, the discharge state determining unit 423 calculates the amount of decrease in the absolute value Vd of the envelope of the discharge voltage with time; when the calculated amount of decrease in the absolute value Vd exceeds a predetermined threshold, the discharge state determining unit 423 determines that a discharge is produced between the center and ground electrodes 22 and 23 of the ignition plug 20. For example, at a time instant t2 (see FIG. 5), the discharge state determining unit 423 determines that a discharge is produced between the center and ground electrodes 22 and 23 of the ignition plug 20.

Referring back to FIG. 4, if a discharge is produced between the center and ground electrodes 22 and 23 of the ignition plug 20 and thus the determination at step S10 results in a "YES" answer, the process proceeds to step S11.

At step S11, the discharge state determining unit 423 causes the timer 424 to start counting time (or measuring elapsed time). Specifically, as shown in FIG. 5(B), the timer 424 starts counting time at, for example, the time instant t2 at which it is determined that a discharge is produced between the center and ground electrodes 22 and 23 of the ignition plug 20.

At step S12, the discharge state determining unit 423 determines whether the absolute value Vd of the envelope of the discharge voltage is greater than or equal to a first threshold value Vth1.

Figure 6:
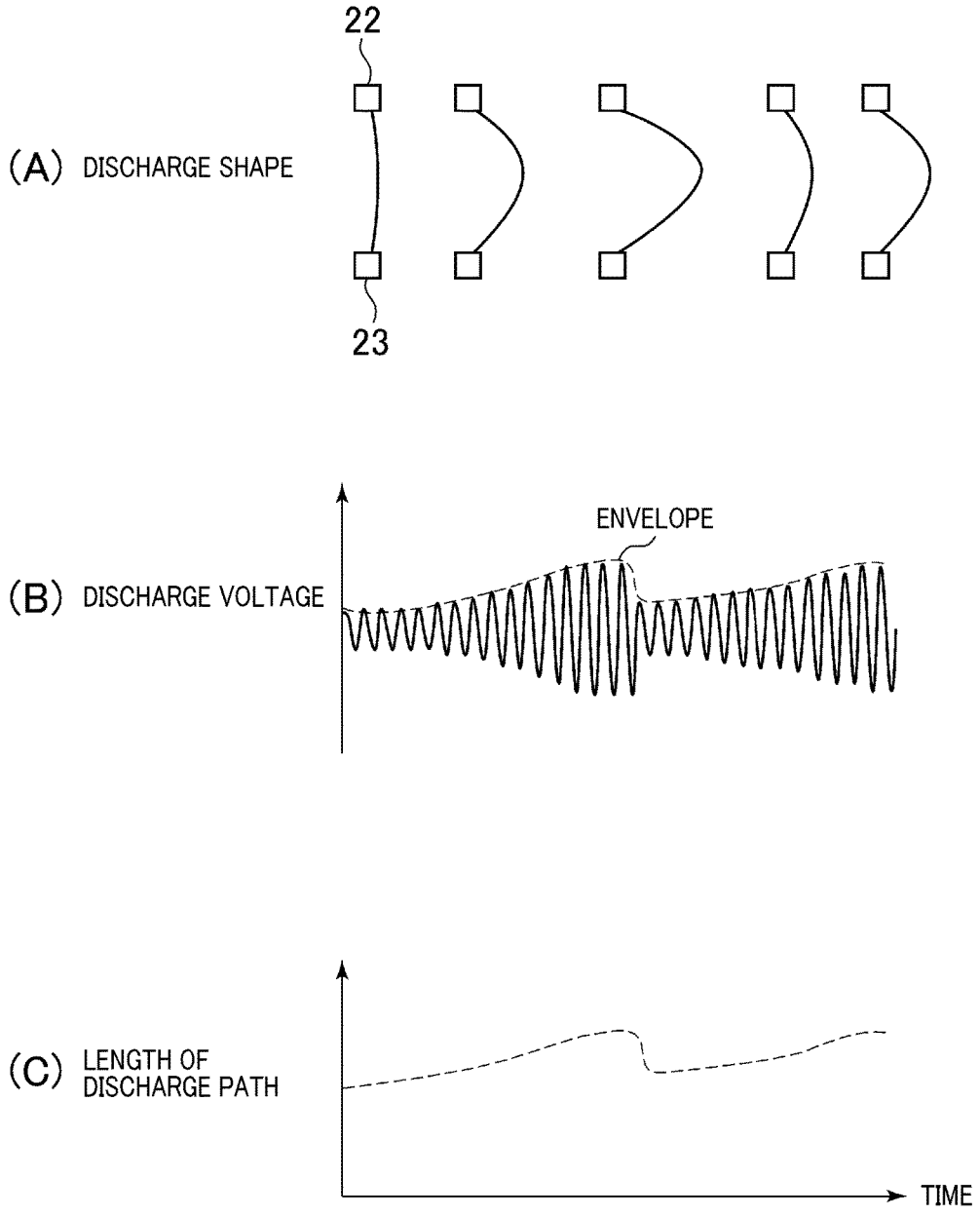
FIG. 6 is a time chart illustrating the relationship between the discharge shape, the discharge voltage and the length of the discharge path, wherein (A) shows the change with time of the discharge shape, (B) shows the change with time of the discharge voltage and (C) shows the change with time of the length of the discharge path.

The discharge path formed between the center and ground electrodes 22 and 23 of the ignition plug 20 may be extended by the flow of the air-fuel mixture in the combustion chamber. With extension of the discharge path, the impedance of the discharge increases and thus the absolute value Vd of the envelope of the discharge voltage also increases. Therefore, as shown in FIG. 6 (A)-(C), there is a correlative relationship between the length of the discharge path and the absolute value Vd of the envelope of the discharge voltage. Accordingly, it is possible to estimate the length of the discharge path on the basis of the absolute value Vd of the envelope of the discharge voltage. In the present embodiment, the first threshold value Vth1 is preset through experiments so that with the first threshold value Vth1, it is possible to determine whether the discharge path is in an over-extended state. Here, the over-extended state denotes a state in which the discharge path formed between the center and ground electrodes 22 and 23 of the ignition plug 20 is excessively extended so that the length of the discharge path becomes greater than or equal to a first threshold length that corresponds to the first threshold value Vth1. In addition, the first threshold value Vth1 is stored in the memory of the controller 42.

Referring back to FIG. 4, if the determination at step S12 results in a "YES" answer, i.e., if the absolute value Vd of the envelope of the discharge voltage is greater than or equal to the first threshold value Vth1 and thus the discharge path is determined as being in the over-extended state, the process proceeds to step S13.

At step S13, the discharge state determining unit 423 outputs a current reduction command signal to the current controlling unit 420; the current reduction command signal is indicative of a command to reduce the AC current supplied to the primary coil 31 of the boost transformer 30. Upon receipt of the current reduction command signal, the current controlling unit 420 sets the voltage duty ratio to a value less than the value that is calculated on the basis of the reference current value Isb. Consequently, the AC current supplied to the primary coil 31 of the boost transformer 30 is reduced and thus the drive current of the ignition plug 20 is also reduced. Moreover, with the reduction in the drive current of the ignition plug 20, the impedance of the discharge is increased. Forming a short circuit of the discharge and thereby shortening the discharge path is advantageous to lowering the impedance of the discharge; thus formation of a short circuit is promoted. As a result, a short circuit of the discharge is formed within the air-fuel mixture so that the discharge path is shortened, thereby being brought out of the over-extended state. After step S13, the process proceeds to step S20.

On the other hand, if the determination at step S12 results in a "NO" answer, i.e., if the absolute value Vd of the envelope of the discharge voltage is less than the first threshold value Vth1 and thus the discharge path is determined as being not in the over-extended state, the process proceeds to step S14.

At step S14, the discharge state determining unit 423 determines whether the absolute value Vd of the envelope of the discharge voltage is less than or equal to a second threshold value Vth2 that is less than the first threshold value Vth1.

In the present embodiment, the second threshold value Vth2 is preset through experiments so that with the second threshold value Vth2, it is possible to determine whether the discharge path is in an insufficiently-extended state. Here, the insufficiently-extended state denotes a state in which the discharge path formed between the center and ground electrodes 22 and 23 of the ignition plug 20 is insufficiently extended so that the length of the discharge path is less than or equal to a second threshold length; the second threshold length corresponds to the second threshold value Vth2 and is less than the first threshold length. In addition, the second threshold value Vth2 is also stored in the memory of the controller 42.

If the determination at step S14 results in a "YES" answer, i.e., if the absolute value Vd of the envelope of the discharge voltage is less than or equal to the second threshold value Vth2, the process proceeds to step S15.

At step S15, the discharge state determining unit 423 checks whether the time T counted by the timer 424 exceeds a first time threshold Tth1.

If the check at step S15 results in a "YES" answer, i.e., if the time T counted by the timer 424 exceeds the first time threshold Tth1, the discharge state determining unit 423 determines that the discharge path is in the insufficiently-extended state. Then, the process proceeds to step S16.

At step S16, the discharge state determining unit 423 outputs a current increase command signal to the current controlling unit 420; the current increase command signal is indicative of a command to increase the AC current supplied to the primary coil 31 of the boost transformer 30. Upon receipt of the current increase command signal, the current controlling unit 420 sets the voltage duty ratio to a value greater than the value that is calculated on the basis of the reference current value Isb. Consequently, the AC current supplied to the primary coil 31 of the boost transformer 30 is increased and thus the drive current of the ignition plug 20 is also increased. Moreover, with the increase in the drive current of the ignition plug 20, the discharge path is extended, thereby being brought out of the insufficiently-extended state. After step S16, the process proceeds to step S20.

On the other hand, if the check at step S15 results in a "NO" answer, i.e., if the time T counted by the timer 424 does not exceed the first time threshold Tth1, the process proceeds to step S20.

Moreover, if the determination at step S14 results in a "NO" answer, i.e., if the absolute value Vd of the envelope of the discharge voltage is greater than the second threshold value Vth2, the process proceeds to step S17.

At step S17, the discharge state determining unit 423 checks whether the time T counted by the timer 424 exceeds a second time threshold Tth2.

In the case where the determination at step S14 results in a "NO" answer, the discharge path is basically at a suitable length. However, even when the discharge path is in a state of having a suitable length, if the state continues too long, the ignition energy will become too large; consequently, the combustion state in the combustion chamber may not be stabilized. In the present embodiment, the second time threshold Tth2 is preset through experiments so that with the second time threshold Tth2, it is possible to determine whether the state where the discharge path is at a suitable length has continued for an excessively long time. In addition, the second time threshold Tth2 is also stored in the memory of the controller 42.

If the check at step S17 results in a "NO" answer, the process proceeds to step S19.

At step S19, the discharge state determining unit 423 outputs a reference current command signal to the current controlling unit 420; the reference current command signal is indicative of a command to supply the primary coil 31 of the boost transformer 30 with the AC current corresponding to the reference current value Isb. Upon receipt of the reference current command signal, the current controlling unit 420 sets the voltage duty ratio to the value that is calculated on the basis of the reference current value Isb. Consequently, the AC current corresponding to the reference current value Isb is supplied to the primary coil 31 of the boost transformer 30. It should be noted the AC current corresponding to the reference current value Isb is simply denoted by "REFERENCE CURRENT" in FIG. 4. After step S19, the process proceeds to step S20.

On the other hand, if the check at step S17 results in a "YES" answer, i.e., if the state where the discharge path is at a suitable length has continued for an excessively long time, the process proceeds to step S18.

At step S18, to prevent the ignition energy from becoming too large, the discharge state determining unit 423 outputs the current reduction command signal to the current controlling unit 420. Upon receipt of the current reduction command signal, the current controlling unit 420 sets the voltage duty ratio to a value less than the value that is calculated on the basis of the reference current value Isb. Consequently, the AC current supplied to the primary coil 31 of the boost transformer 30 is reduced and thus the drive current of the ignition plug 20 is also reduced. Moreover, with the reduction in the drive current of the ignition plug 20, the discharge path is shortened, thereby suppressing increase in the ignition energy. After step S18, the process proceeds to step S20.

At step S20, the discharge state determining unit 423 determines whether a short circuit of the discharge between the center and ground electrodes 22 and 23 of the ignition plug 20 has been formed.

When a short circuit of the discharge has been formed, the amount of change in the absolute value Vd of the envelope of the discharge voltage with time becomes a negative value; in other words, the absolute value Vd of the envelope of the discharge voltage changes with time in the negative direction. Moreover, the magnitude of the amount of change is greater than that in the case where the discharge shape changes without a short circuit. Furthermore, when the discharge is blown off by the flow of the air-fuel mixture in the combustion chamber, the absolute value Vd of the envelope of the discharge voltage decreases to a minimum discharge-sustaining voltage between the center and ground electrodes 22 and 23 of the ignition plug 20.

In view of the above, in the present embodiment, the discharge state determining unit 423 determines that a short circuit of the discharge has been formed based on the fact that: the amount of change in the absolute value Vd of the envelope of the discharge voltage with time in the negative direction exceeds a threshold amount; and the absolute value Vd of the envelope of the discharge voltage at the change-ending time instant exceeds the minimum discharge-sustaining voltage. Here, the change-ending time instant denotes the time instant at which the change with time of the absolute value Vd of the envelope of the discharge voltage in the negative direction ends. The threshold amount is preset through experiments to a negative value and stored in the memory of the controller 42.

For example, in the case where the absolute value Vd of the envelope of the discharge voltage changes as shown in FIG. 5(A) and the minimum discharge-sustaining voltage is set to 0.5 kV, the discharge state determining unit 423 determines, at each of time instants t3, t4 and t5, that a short circuit of the discharge has been formed.

Referring back to FIG. 4, if the determination at step S20 results in a "YES" answer, i.e., if it is determined that a short circuit of the discharge has been formed, the process proceeds to step S21.

At step S21, the discharge state determining unit 423 resets the time counted by the timer 424 to zero. For example, in the case where the discharge state determining unit 423 determines that a short circuit of the discharge has been formed at each of the time instants t3, t4 and t5 as shown in FIG. 5(A), the time counted by the timer 424 is reset to zero at each of the time instants t3, t4 and t5 as shown in FIG. 5(B). After step S21, the process proceeds to step S22.

On the other hand, if the determination at step S20 results in a "NO" answer, the process directly proceeds to step S22 skipping step S21.

At step S22, the discharge state determining unit 423 determines whether the ignition signal IGw is switched from the ON state to the OFF state.

If the determination at step S22 results in a "NO" answer, i.e., if the ignition signal IGw is kept in the ON state, the process returns to step S12.

On the other hand, if the determination at step S22 results in a "YES" answer, i.e., if the ignition signal IGw is switched from the ON state to the OFF state, the process goes to the end.

According to the present embodiment, it is possible to achieve the following advantageous effects.

In the present embodiment, the ignition apparatus 10 includes the ignition plug 20, the boost transformer 30, the ignition power source 40 and the measurement device (or measurement unit) 60. The ignition plug 20 has the center electrode 22 and the ground electrode 23 to produce a discharge therebetween upon being supplied with electric power. The boost transformer 30 has the primary coil 31 and the secondary coil 32 magnetically coupled with each other. The boost transformer 30 is configured to supply the ignition plug 20 with the electric power that is generated in the secondary coil 32 by electromagnetic induction upon supply of AC power to the primary coil 31. The ignition power source 40 is configured to supply the primary coil 31 of the boost transformer 30 with the AC power. The measurement device 60 is configured to measure the discharge voltage of the ignition plug 20. Moreover, the ignition power source 40 includes the controller 42 that has the discharge state determining unit 423 configured to determine the discharge state of the ignition plug 20 based on the discharge voltage of the ignition plug 20 measured by the measurement device 60 and the current controlling unit 420 configured to control the AC current supplied to the primary coil 31 of the boost transformer 30. When the discharge path formed between the center and ground electrodes 22 and 23 of the ignition plug 20 is determined by the discharge state determining unit 423 as being in the over-extended state, the current controlling unit 420 reduces the AC current supplied to the primary coil 31 of the boost transformer 30.

With the above configuration, when the discharge path formed between the center and ground electrodes 22 and 23 of the ignition plug 20 is excessively extended by the flow of the air-fuel mixture in the combustion chamber, the AC current supplied to the primary coil 31 of the boost transformer 30 is reduced by the current controlling unit 420, thereby reducing the drive current of the ignition plug 20. Moreover, with the reduction in the drive current of the ignition plug 20, the impedance of the discharge is increased. Forming a short circuit of the discharge and thereby shortening the discharge path is advantageous to lowering the impedance of the discharge; thus formation of a short circuit is promoted. Consequently, a short circuit of the discharge is formed within the air-fuel mixture, thereby shortening the discharge path. As a result, it becomes possible to prevent the discharge path from becoming excessively long, thereby suppressing variation in the discharge shape between each combustion cycle.

Moreover, in the present embodiment, the discharge state determining unit 423 determines that the discharge path is in the over-extended state based on the fact that the absolute value Vd of the envelope of the discharge voltage measured by the measurement device 60 is greater than or equal to the first threshold value (or over-extension threshold value) Vth1.

There is a correlative relationship between the length of the discharge path and the absolute value Vd of the envelope of the discharge voltage (see FIG. 6 (A)-(C)). Therefore, with the above configuration, it is possible to easily and reliably determine whether the discharge path is in the over-extended state.

Figure 4:
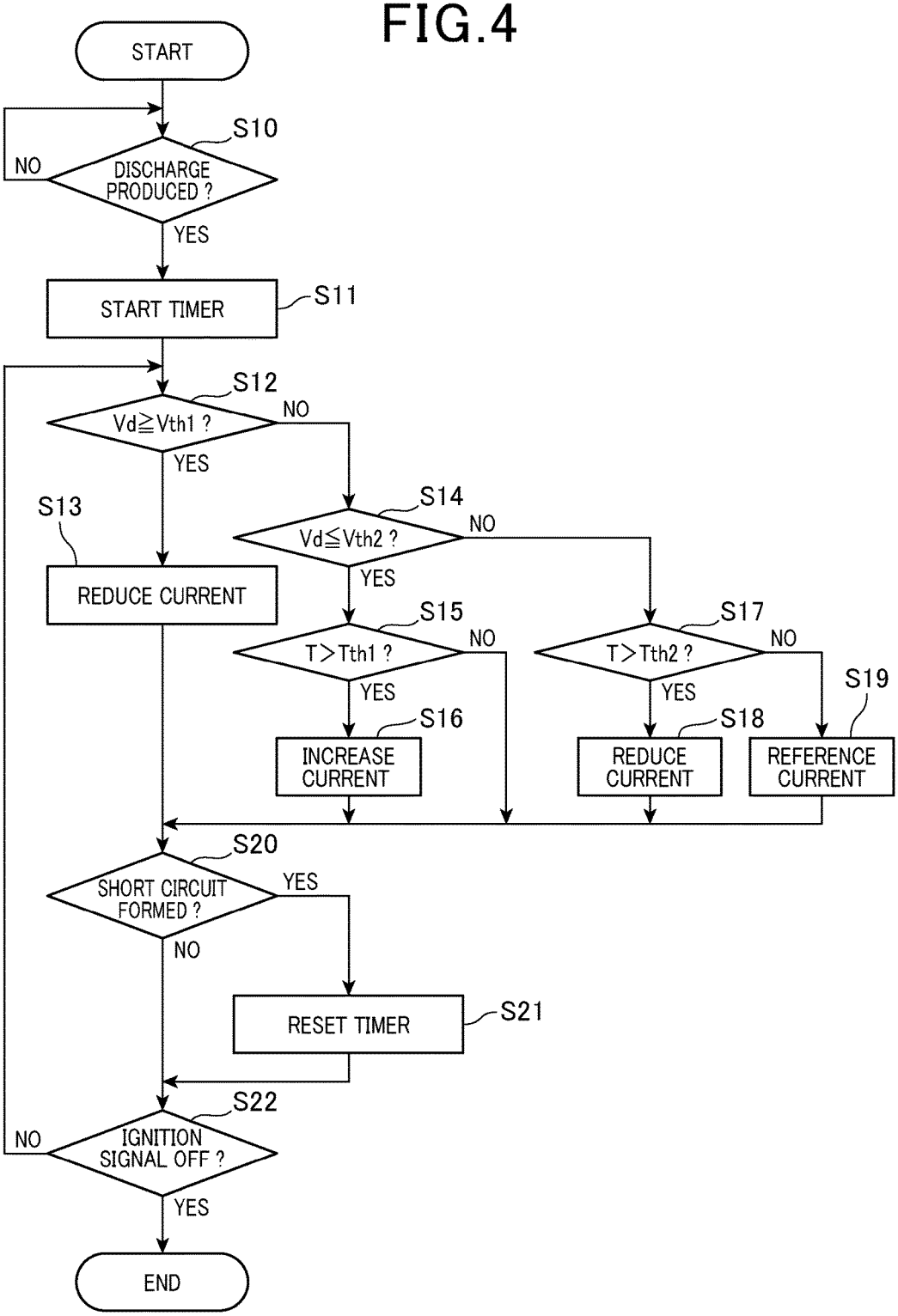
FIG. 4 is a flowchart illustrating a process performed by the controller for adjusting drive current of the ignition plug.

In the present embodiment, the discharge state determining unit 423 is configured to: cause the timer 424 to start counting time when the discharge is produced in the ignition plug 20 (see step S11 of FIG. 4); determine whether a short circuit of the discharge has been formed (see step S20 of FIG. 4); reset the time T counted by the timer 424 to zero when it is determined that a short circuit of the discharge has been formed (see step S21 of FIG. 4); and determine (or check) whether the time T counted by the timer 424 exceeds the second time threshold Tth2 (see step S17 of FIG. 4). When it is determined by the discharge state determining unit 423 that the time T counted by the timer 424 exceeds the second time threshold Tth2, the current controlling unit 420 reduces the AC current supplied to the primary coil 31 of the boost transformer 30.

With the above configuration, even when the discharge path is in a state of having a suitable length, if the state continues too long, the AC current supplied to the primary coil 31 of the boost transformer 30 will be reduced by the current controlling unit 420, thereby reducing the drive current of the ignition coil 20. Consequently, it is possible to prevent the discharge formation time from becoming too long, thereby suppressing variation in the combustion state between different combustion cycles.

In the present embodiment, the discharge state determining unit 423 determines that a short circuit of the discharge has been formed based on the fact that: the amount of change in the absolute value Vd of the envelope of the discharge voltage with time in the negative direction exceeds the threshold amount which is preset to a negative value; and the absolute value Vd of the envelope at the time instant, at which the change with time of the absolute value Vd of the envelope in the negative direction ends, exceeds the minimum discharge-sustaining voltage.

With the above configuration, it is possible to easily and reliably determine whether a short circuit of the discharge has been formed.

In the present embodiment, the discharge state determining unit 423 determines that the discharge path is in the insufficiently-extended state based on the fact that the state of the absolute value Vd of the envelope of the discharge voltage being less than or equal to the second threshold value (or insufficient-extension threshold value) Vth2 continues over the first time threshold Tth1. When the discharge path is determined by the discharge state determining unit 423 as being the insufficiently-extended state, the current controlling unit 420 increases the AC current supplied to the primary coil 31 of the boost transformer 30.

With the above configuration, when the insufficiently-extended state of the discharge path continues over the first time threshold Tth1 and thus a combustion cycle of very poor ignitability is likely to occur, the AC current supplied to the primary coil 31 of the boost transformer 30 is increased by the current controlling unit 420, thereby increasing the drive current of the ignition plug 20. Consequently, it becomes difficult for a short circuit of the discharge to be formed in the ignition plug 20. As a result, the ignitability is improved, thereby more effectively suppressing variation in the discharge shape between each combustion cycle.

In the present embodiment, the current controlling unit 420 is configured to adjust (i.e., increase or reduce) the AC current supplied to the primary coil 31 of the boost transformer 30 by varying the voltage duty ratio that determines the magnitude of the AC voltage applied by the ignition power source 40 to the primary coil 31 of the boost transformer 30.

With the above configuration, it is possible to easily and reliably adjust the AC current supplied to the primary coil 31 of the boost transformer 30.

[First Modification]

Figure 7:
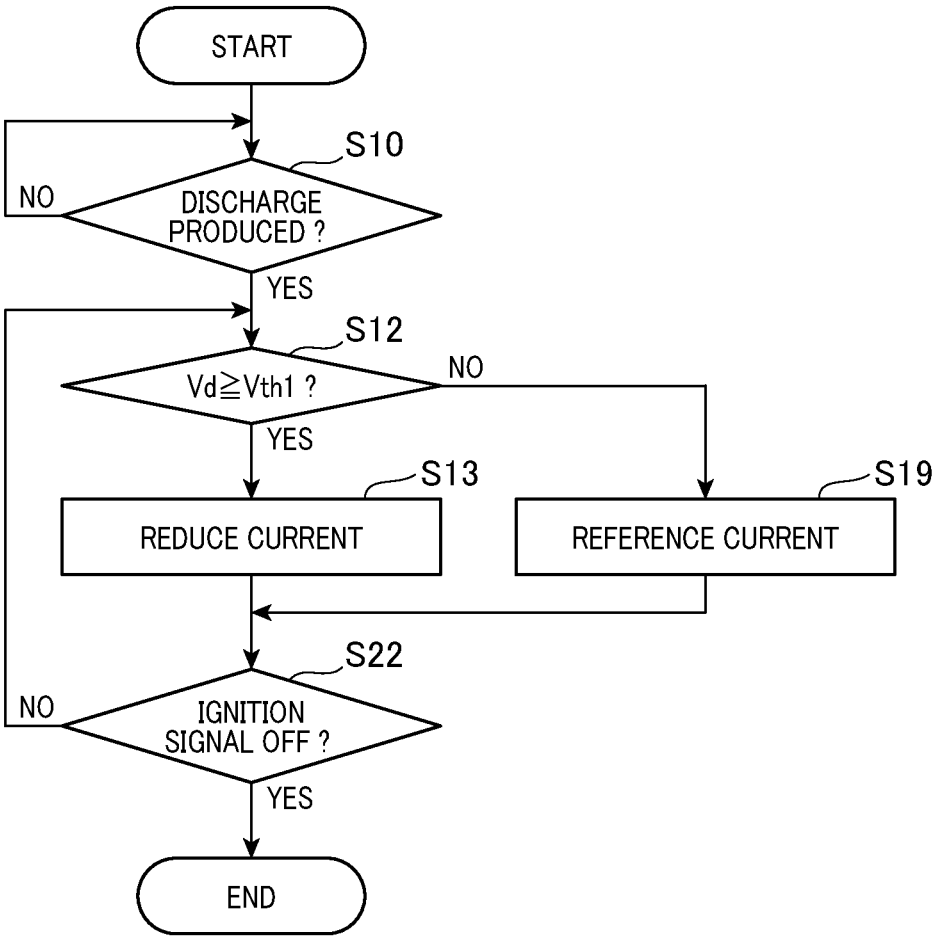
FIG. 7 is a flowchart illustrating a process performed by a controller according to a first modification for adjusting the drive current of the ignition plug.

In this modification, as shown in FIG. 7, after step S13, the process performed by the controller 42 directly proceeds to step S22, omitting step S20 (see FIG. 4) described in the above embodiment. Moreover, if the determination at step S12 produces a "NO" answer, the process directly proceeds to step S19, omitting steps S14-S18 (see FIG. 4) described in the above embodiment.

[Second Modification]

In this modification, at steps S13, S16 and S18 of the process described in the above embodiment with reference to FIG. 4, the AC current supplied to the primary coil 31 of the boost transformer 30 is adjusted by varying, instead of the voltage duty ratio, the frequency of the AC voltage applied by the ignition power source 40 to the primary coil 31 of the boost transformer 30.

Figure 8:
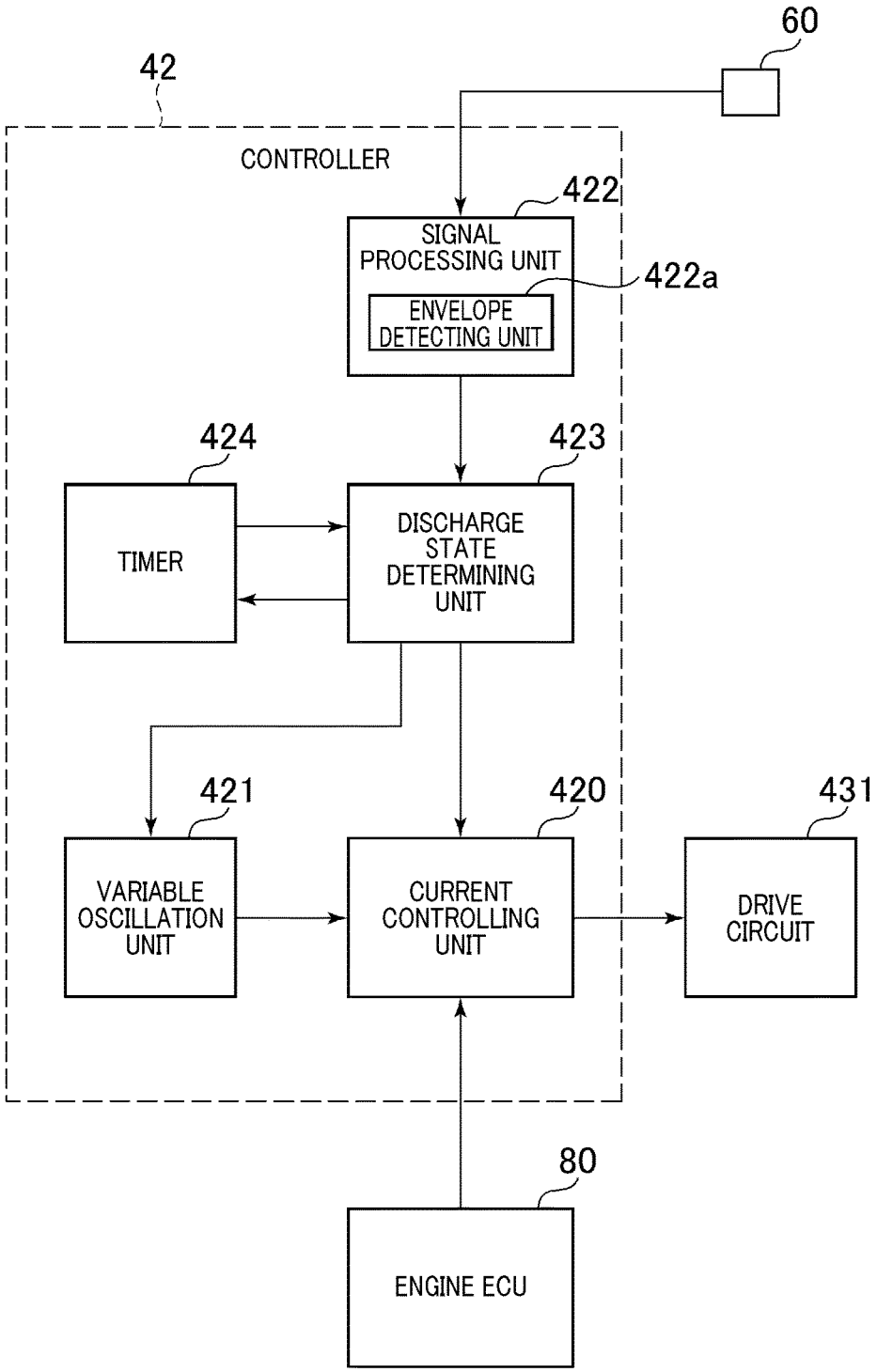
FIG. 8 is a block diagram illustrating the configuration of a controller according to a second modification.

Specifically, in this modification, as shown in FIG. 8, the controller 42 includes, instead of the oscillation unit 421 described in the above embodiment with reference to FIG. 3, a variable oscillation unit 421 that is capable of varying the frequency of a carrier signal generated by it and outputted from it to the current controlling unit 420. The discharge state determining unit 423 outputs a frequency increase command signal or a frequency reduction command signal to the variable oscillation unit 421, thereby causing the variable oscillation unit 421 to raise or lower the frequency of the carrier signal and thereby raising or lowering the frequency of the AC voltage applied by the ignition power source 40 to the primary coil 31 of the boost transformer 30.

[Third Modification]

In this modification, at steps S13, S16 and S18 of the process described in the above embodiment with reference to FIG. 4, the AC current supplied to the primary coil 31 of the boost transformer 30 is adjusted by varying, instead of the voltage duty ratio, the DC voltage applied by the DC-DC converter 50 to the ignition power source 40.

Figure 9:
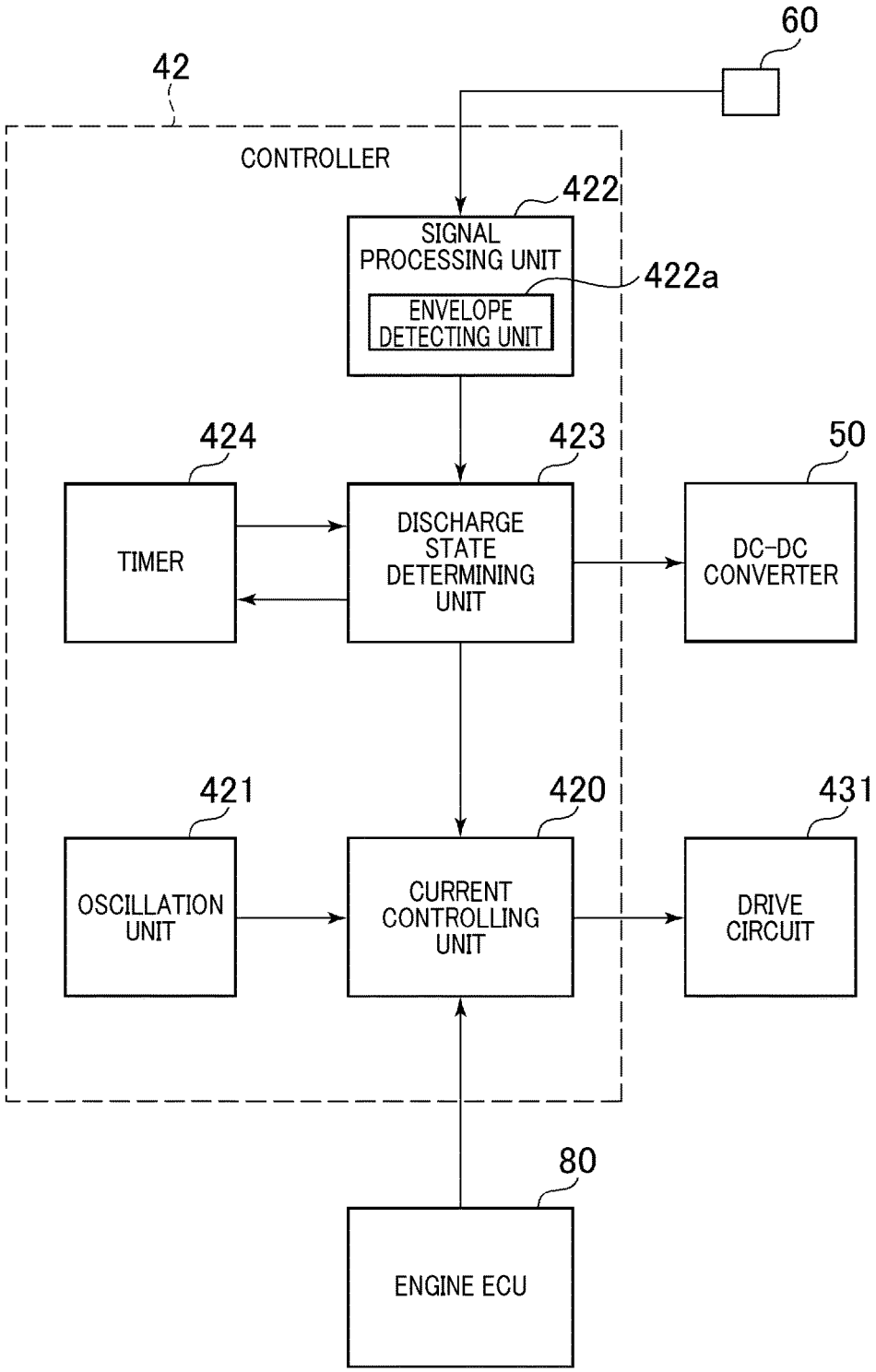
FIG. 9 is a block diagram illustrating the configuration of a controller according to a third modification.

Specifically, in this modification, as shown in FIG. 9, the discharge state determining unit 423 outputs a voltage increase command signal or a voltage reduction command signal to the DC-DC converter 50, thereby causing the DC-DC converter 50 to raise or lower the DC voltage applied to the ignition power source 40.

[Fourth Modification]

In this modification, at steps S13, S16 and S18 of the process described in the above embodiment with reference to FIG. 4, the AC current supplied to the primary coil 31 of the boost transformer 30 is adjusted by varying, instead of the voltage duty ratio, the root mean square value (or effective value) of the AC voltage applied by the ignition power source 40 to the primary coil 31 of the boost transformer 30.

[Fifth Modification]

In this modification, the measurement device 60 measures (or detects), instead of the discharge voltage, the discharge current (or drive current) supplied to the ignition plug 20. The envelope detecting unit 422*a* of the signal processing unit 422 detects the envelope of the discharge current of the ignition plug 20. Moreover, in the process described in the above embodiment with reference to FIG. 4, the discharge state determining unit 423 uses the absolute value of the envelope of the discharge current instead of the absolute value Vd of the envelope of the discharge voltage.

With the above configuration, it is also possible to achieve the same advantageous effects as described in the above embodiment.

While the above particular embodiment and modifications have been shown and described, it will be understood by those skilled in the art that various further modifications, changes, and improvements may be made without departing from the spirit of the present invention.

For example, the means/functions provided by the controller 42 may be implemented by only software, only hardware or a combination of software and hardware. Moreover, in the case of configuring the controller 42 with an electronic circuit (i.e., hardware), the electronic circuit may be a digital circuit that includes a number of logic circuits or an analog circuit.

The ignition apparatus 10 may be implemented by combining a conventional ignition coil with an AC power source or by an ignition coil which includes an AC power source.

The various elements described in the above embodiment and modifications may be combined with each other in any suitable manner.

What is claimed is:

1. An ignition apparatus comprising:

an ignition plug having a center electrode and a ground electrode to produce a discharge therebetween upon being supplied with electric power;

a boost transformer having a primary coil and a secondary coil magnetically coupled with each other, the boost transformer being configured to supply the ignition plug with the electric power that is generated in the secondary coil by electromagnetic induction upon supply of AC power to the primary coil;

an ignition power source configured to supply the primary coil of the boost transformer with the AC power; and a measurement unit configured to measure at least one of discharge voltage and discharge current of the ignition plug, wherein the ignition power source includes a controller that has a discharge state determining unit configured to determine a discharge state of the ignition plug based on the at least one of the discharge voltage and the discharge current measured by the measurement unit when a discharge is produced between the center and ground electrodes of the ignition plug to ignite an air-fuel mixture in a combustion chamber, and a current controlling unit configured to control electric current supplied to the primary coil of the boost transformer, and the controller is configured so that when a discharge path formed between the center and ground electrodes of the ignition plug is determined by the discharge state determining unit as being in an over-extended state, the current controlling unit reduces the electric current supplied to the primary coil of the boost transformer.

2. The ignition apparatus as set forth in claim 1, wherein the discharge state determining unit determines that the discharge path is in the over-extended state based on the fact that an absolute value of an envelope of the discharge voltage or the discharge current is greater than or equal to a predetermined over-extension threshold value.

3. The ignition apparatus as set forth in claim 1, wherein the controller further has a timer that counts time, the discharge state determining unit is configured to:

cause the timer to start counting time when the discharge is produced in the ignition plug, determine whether a short circuit of the discharge between the center and ground electrodes of the ignition plug has been formed, reset the time counted by the timer when it is determined that a short circuit of the discharge has been formed, and determine whether the time counted by the timer exceeds a predetermined time threshold, and when it is determined by the discharge state determining unit that the time counted by the timer exceeds the predetermined time threshold, the current controlling unit reduces the electric current supplied to the primary coil of the boost transformer.

4. The ignition apparatus as set forth in claim 3, wherein the discharge state determining unit determines that a short circuit of the discharge has been formed based on the fact that: an amount of change in an absolute value of an envelope of the discharge voltage or the discharge current with time in a negative direction exceeds a threshold amount which is preset to a negative value; and the absolute value of the envelope at a time instant, at which the change with time of the absolute value of the envelope in the negative direction ends, exceeds a minimum discharge-sustaining voltage.

5. The ignition apparatus as set forth in claim 1, wherein the discharge state determining unit determines that the discharge path is in an insufficiently-extended state based on the fact that a state of an absolute value of an envelope of the discharge voltage or the discharge current being less than or equal to a predetermined insufficient-extension threshold value continues over a predetermined time threshold, and when the discharge path is determined by the discharge state determining unit as being the insufficiently-extended state, the current controlling unit increases the electric current supplied to the primary coil of the boost transformer.

6. The ignition apparatus as set forth in claim 1, wherein the current controlling unit is configured to adjust the electric current supplied to the primary coil of the boost transformer by varying at least one of a duty ratio that determines the magnitude of AC voltage applied by the ignition power source to the primary coil of the boost transformer, the frequency of the AC voltage, the root mean square value of the AC voltage and a voltage applied to the ignition power source to produce the AC voltage.

7. An ignition apparatus comprising:

an ignition plug having a center electrode and a ground electrode to produce a discharge therebetween upon being supplied with electric power;

a boost transformer having a primary coil and a secondary coil magnetically coupled with each other, the boost transformer being configured to supply the ignition plug with the electric power that is generated in the secondary coil by electromagnetic induction upon supply of AC power to the primary coil;

an ignition power source configured to supply the primary coil of the boost transformer with the AC power; and a measurement unit configured to measure at least one of discharge voltage and discharge current of the ignition plug, wherein the ignition power source includes a controller that has a discharge state determining unit configured to determine a discharge state of the ignition plug based on the at least one of the discharge voltage and the discharge current measured by the measurement unit and a current controlling unit configured to control electric current supplied to the primary coil of the boost transformer, and the controller is configured so that when a discharge path formed between the center and ground electrodes of the ignition plug is determined by the discharge state determining unit as being in an over-extended state, the current controlling unit reduces the electric current supplied to the primary coil of the boost transformer;

the controller further has a timer that counts time, the discharge state determining unit is configured to:

cause the timer to start counting time when the discharge is produced in the ignition plug, determine whether a short circuit of the discharge between the center and ground electrodes of the ignition plug has been formed, reset the time counted by the timer when it is determined that a short circuit of the discharge has been formed, and determine whether the time counted by the timer exceeds a predetermined time threshold, and when it is determined by the discharge state determining unit that the time counted by the timer exceeds the predetermined time threshold, the current controlling unit reduces the electric current supplied to the primary coil of the boost transformer.

8. The ignition apparatus as set forth in claim 7, wherein the discharge state determining unit determines that a short circuit of the discharge has been formed based on the fact that: an amount of change in an absolute value of an envelope of the discharge voltage or the discharge current with time in a negative direction exceeds a threshold amount which is preset to a negative value; and the absolute value of the envelope at a time instant, at which the change with time of the absolute value of the envelope in the negative direction ends, exceeds a minimum discharge-sustaining voltage.

9. An ignition apparatus comprising:

an ignition plug having a center electrode and a ground electrode to produce a discharge therebetween upon being supplied with electric power;

a boost transformer having a primary coil and a secondary coil magnetically coupled with each other, the boost transformer being configured to supply the ignition plug with the electric power that is generated in the secondary coil by electromagnetic induction upon supply of AC power to the primary coil;

an ignition power source configured to supply the primary coil of the boost transformer with the AC power; and a measurement unit configured to measure at least one of discharge voltage and discharge current of the ignition plug, wherein the ignition power source includes a controller that has a discharge state determining unit configured to determine a discharge state of the ignition plug based on the at least one of the discharge voltage and the discharge current measured by the measurement unit and a current controlling unit configured to control electric current supplied to the primary coil of the boost transformer, and the controller is configured so that when a discharge path formed between the center and ground electrodes of the ignition plug is determined by the discharge state determining unit as being in an over-extended state, the current controlling unit reduces the electric current supplied to the primary coil of the boost transformer, the discharge state determining unit determines that the discharge path is in an insufficiently-extended state based on the fact that a state of an absolute value of an envelope of the discharge voltage or the discharge current being less than or equal to a predetermined insufficient-extension threshold value continues over a predetermined time threshold, and when the discharge path is determined by the discharge state determining unit as being the insufficiently-extended state, the current controlling unit increases the electric current supplied to the primary coil of the boost transformer.

* * * * *